United States Patent [19]

Raees et al.

[11] 4,244,582

[45] Jan. 13, 1981

[54] PERSONALIZED CARD PACK PRODUCING METHOD

[76] Inventors: Mohammad Raees, No. 1-2, Minami Kata 2-chome, Okayama-shi, Okayama-ken; Yasushi Hayashibara, No. 372-1, Hama, Okayama-shi, Okayama-ken, both of Japan

[21] Appl. No.: 18,021

[22] Filed: Mar. 6, 1979

[30] Foreign Application Priority Data

Mar. 13, 1978 [JP] Japan ..... 53-31851

[51] Int. Cl.[3] ..... A63F 1/02

[52] U.S. Cl. ..... 273/293; 40/2.2

[58] Field of Search ..... 273/293, 294, 295; 40/2.2, 360; 156/384, 387

[56] References Cited

U.S. PATENT DOCUMENTS

| | | | |
|---|---|---|---|
| 1,890,504 | 12/1932 | Ferguson | 273/295 X |
| 2,663,418 | 12/1953 | Grunwald | 273/293 X |

FOREIGN PATENT DOCUMENTS

| | | | |
|---|---|---|---|
| 2164450 | 7/1973 | Fed. Rep. of Germany | 273/293 |

*Primary Examiner*—Anton O. Oechsle

*Attorney, Agent, or Firm*—Blanchard, Flynn, Thiel, Boutell & Tanis

[57] ABSTRACT

Cards such as playing cards have numerals or patterns corresponding to the play, printed on their one sides, while, on the other sides of these cards, printed is a common pattern. According to the invention, attractive and amusing cards of the user's own can be obtained, because the cards are so produced as to allow the user to print his favorite pattern, such as portrait of his family, actor or actress, automobile, airplane and the like, as the common pattern on the other sides of the cards.

4 Claims, 6 Drawing Figures

PERSONALIZED CARD PACK PRODUCING METHOD

BACKGROUND OF THE INVENTION

The present invention relates to a pack or set of cards for games such as playing cards, in which each card has one side presented for the printing of user's favourite pattern, photograph or the like.

As is well known, a pack of cards such as playing cards has a plurality of cards each of which having its own character or symbol printed on its reverse side while the obverse sides of the cards carry a common pattern printed thereon.

Since the pattern on the obverse sides of cards is conspicuous during the use of the cards, the user selects a pack of card having a pattern which is most attractive to him, from a plurality of packs having various patterns printed on their obverse sides, when he purchases the card. However, the user is not always satisfied with the pattern he has selected, because he might have made a compromise in selecting the pattern from a plurality of already-made patterns.

As far as the present inventors have noticed, there have been no cards such as playing cards or the like offering their obverse sides for the printing of user's favourite pattern.

SUMMARY OF THE INVENTION

Under this circumstance, the present invention aims at providing cards for game purpose such as playing cards, in which each card offers its obverse side for the printing of user's favourite photograph, pattern or the like, so as to render the cards and the game more amusing.

To this end, according to the invention, there is provided cards for game purpose such as playing cards in which each card carries a pattern, symbol, character, numeral or the like essential for the game printed on its reverse side, while the obverse sides of the cards are kept blank so as to allow the user to provide his favourite pattern, numerals and the like on the obverse side.

The above and other objects, as well as advantageous features of the invention will become more clear from the following description of the preferred embodiment taken in conjunction with the accompanying drawings.

DESCRIPTION OF THE PREFERRED EMBODIMENTS

Figure 1:
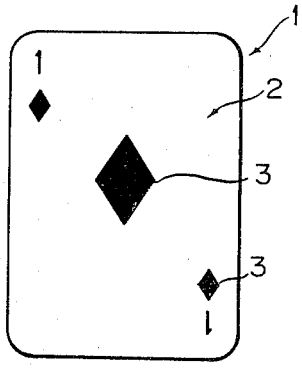
FIG. 1 is a plan view of the reverse side of a card in accordance with the invention.
Figure 2:
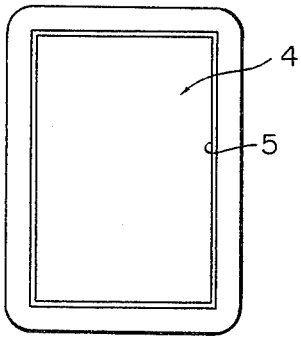
FIG. 2 is a plan view of the obverse side of the card as shown in FIG. 1.
Figure 3:
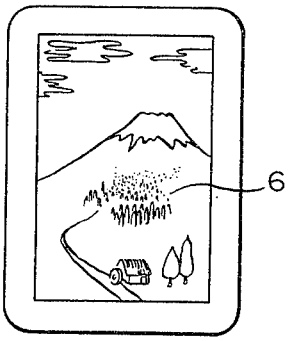
FIG. 3 shows a plan view of the obverse side of the card on which an user's favourite pattern has been printed.

Preferred embodiments of the invention will be described hereinunder with reference to the accompanying drawings.

Referring to the drawings, a reference numeral 1 denotes a card body obtained by cutting a photographic sensitized paper into a rectangular piece of a predetermined size. Marks such as hearts or spades and required symbols such as numerals, generally designated at a numeral 3, are printed on the non-sensitized reverse side 2 of the card body, i.e. on the surface of the carrier paper. The obverse side 4 of the card body has been sensitized by an emulsion applied thereto. This obverse side is kept untreated and ready for printing. It is possible, however, to print beforehand a decorative frame 5 on the peripheral portion of the obverse side 4. In such a case, the frame 5 plays the double role of a frame for the later-effected printing and decoration.

In case that the card body 1 is for playing cards, 53 cards which constitute a set of cards are packed in a complete light-shielding condition for selling.

According to the invention, therefore, the user can print his favourite photograph or pattern, e.g. the photograph of his children, family, friend, sweetheart, actor or actress, singer, scenery, flowers, automobile, airplane, pet and so forth or his original design or picture. The printing is effected in the same manner as the ordinary photographic printing, by making use of a negative of the photograph. In case of the design or the picture, a negative film of a photograph of such a design or picture is used. By effecting the printing on the obverse sides 4 of all card bodies 1, it is possible to obtain a pack of playing cards in which all of 53 cards carry a common pattern 6 on their obverse sides.

Needless to say, a monochromatic pattern or a color pattern can be obtained depending on whether the material sensitized paper is for monochromatic or color printing.

Figure 4:
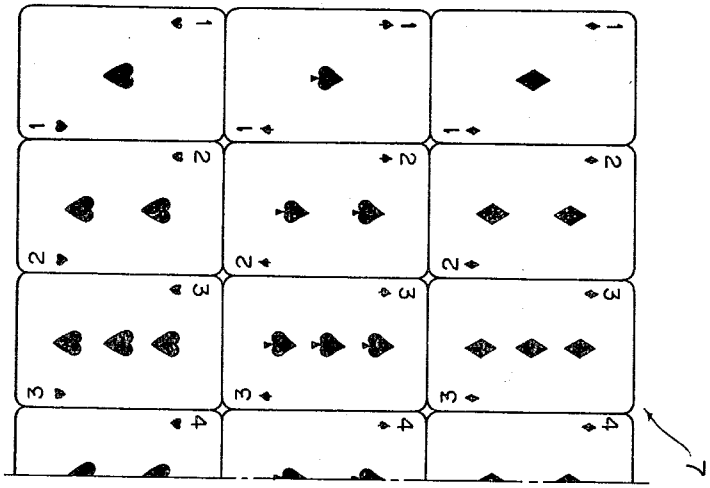
FIG. 4 is a plan view of a plurality of cards, for explaining a process for forming a plurality of cards successively.

Alternatively, the printing of the user's favourite pattern may be effected before a sheet of blank material is cut into separate card bodies. In such a case, as shown in FIG. 4, the symbols 3 corresponding to 53 cards are beforehand printed on the non-sensitized side of a large sheet of sensitized paper 7. Then, after printing the user's favourite pattern successively on the obverse side of the sensitized paper 7 at portions of the latter corresponding to respective card bodies, the sensitized paper 7 is cut into separate cards.

In still another form of the invention, the card body 1 is made of a color or monochromatic copying paper. The symbol 3 has been printed beforehand on the non-sensitized side of each card body 1. The user then effects a copy, making use of his favourite design as the original, on the sensitized side of the card body. By so doing, it is possible to obtain a pack of playing cards in which the desired pattern is printed on the obverse sides of all cards.

In still another form of the invention, the card body 1 is made of an ordinary paper. The symbol 3 is beforehand printed on the reverse side 2 of the card body, while the obverse side 4 of the card body 1 is kept blank. The user plates a printing original paper in which his favourite pattern is drawn, in contact with the obverse side 4, and effects the printing by means of a commercially available simple printer. As a result, a pack of play cards similar to those of the foregoing embodiments can be obtained.

In the above-described embodiments, the desired pattern, symbol, character, numeral or the like is printed photographically by making use of a negative or manually making use of an original copying paper in which the user's favourite pattern has been drawn.

According to the invention, however, the manner of "printing" of the user's favourite pattern is not limited to those of the described embodiments. For instance, mechanical printing, so-called printing which employs a dry or wet type copying machine, stamping and other methods can be adopted in printing the user's favourite pattern. The material of the card body is selected in accordance with the manner of the "printing".

It is therefore possible to use a paper, plastic or the like as the material of the card body 1. At the same time, the card body 1 can have any desired size and shape, e.g. rectangular, circular, or oval shape, or a composite shape of these shapes. Also, the card body 1 can have any desired thickness, by selecting the material such as relatively thin film or sheet, or relatively thick plate-like material.

A further practical embodiment of the invention will be described hereinunder. In the foregoing embodiments, the card body 1 is made of a sheet of material. However, this is not exclusive and the card body can have a laminated construction having two, three or more layers. The "lamination" is made by means of an adhesive. This laminated construction offers various advantages which can never be attained by the card body 1 in the foregoing embodiments constituted by a single sheet. Namely, it is possible, for example, to combine two different materials such as a sheet of a paper and a film of a plastic. In addition, the lamination improves the durability of the card, even when relatively thin materials are used, so that the card can stand a longer use.

Figure 5:
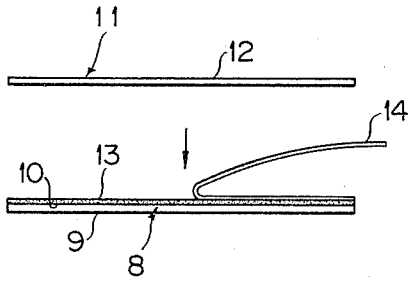
FIG. 5 shows another embodiment in which each card is constituted by two sheets of elements.

Referring to FIG. 5, a reverse body 8 has a surface 9 on which the pattern, e.g. a pattern of diamond as shown in FIG. 1, symbol, character, numeral and the like, which are necessary for the game, are printed. The other surface 10 on which no printing is made constitutes a bonding or adhesion surface. On the other hand, an obverse body 11 has a surface 12 on which printed is a picture which is favour with the user, potrait of the user's family, pattern, symbol, character, numeral or the like.

In use, the obverse body 11 is adhered at its other surface to the adhesion surface 10 of the reverse body 8, so as to form a laminated card for playing purpose. The adhesion surface 10 of the reverse body 8 may be beforehand applied with an adhesive 13 and coated with a peelable paper 14. Alternatively, a paste or the like adhesive may be applied when both bodies 8, 11 are adhered to each other.

Figure 6:
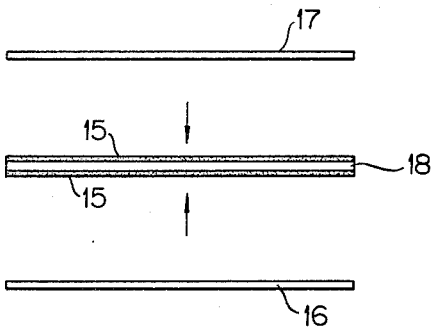
FIG. 6 shows still another embodiment in which each card is constituted by three sheets of elements.

Referring now to FIG. 6 showing a still further embodiment, a reference numeral 18 denotes a base body which constitutes an intermediate layer. The base body 18 is coated at its one or both surfaces with an adhesive 15. In this embodiment, a reverse body 16 and an obverse body 17 which are similar to those of FIG. 5 may be adhered at a time or, alternatively, the reverse body 16 is beforehand adhered to the base body 18 and, when the card is to be used, the obverse body 17 is adhered.

It is fairly possible to produce a set of the playing cards as shown in FIGS. 5 and 6 in the same way as the process shown in FIG. 4. In this case, sheet materials of a large size of respective layers are superposed and adhered that the patterns, symbols or the like of each card printed on the reverse and obverse layers correctly correspond to and aligned with each other. Then, the laminated sheet material is cut into the required number of separate laminated cards.

As has been described, according to the invention, there is provided a pack of card for game or playing purpose, in which each card has a predetermined pattern or the like beforehand printed on its reverse side, while the obverse side thereof is kept blank so as to allow the user to print or draw his favourite pattern. Therefore, a practical advantage is derived that the user can produce quite easily and at low cost a pack of cards such as playing cards, which is attractive amusing thanks to a pattern of reminiscence, design of his original work or the like printed on the obverse sides of the cards.

What is claimed is:

1. A method for producing a pack of cards for game or playing purposes, comprising the steps of:

forming for each card a reverse body by printing on one side thereof a pattern, symbol, character, numeral or the like necessary to the game or play, and by applying to the other side thereof an adhesion surface;

providing for each card an obverse body separate from said reverse body with said obverse body having one side substantially blank and suitable for subsequent applying of a personalized design by the user and the other side suitable for securement to said adhesive surface;

when the cards are to be used, printing said one sides of said obverse bodies of said pack of cards with a pattern, symbol, character, numeral or other personalized design which is a favorite of the user, and covering said adhesion surfaces of said reverse bodies with said other sides of said obverse bodies, and therewith producing a pack of laminated cards.

2. The method of claim 1, wherein the step of forming said reverse body includes adhering a base body and a further body to each other, the step of adhering said obverse body including adhering said obverse body to the side of said base body opposite said further body such that said base body is disposed therebetween to constitute an intermediate layer.

3. The method of claim 1 including the step of temporarily covering said adhesion surface of said reverse body with a peelable layer after applying said adhesive layer; and after said printing of said obverse body with a said favorite design of the user, peeling said peelable layers from said adhesion surfaces of said reverse bodies to permit said covering of said adhesion layers with said obverse bodies.

4. A method for producing a pack of cards for game or playing purposes, comprising the steps of:

forming of sheet material a reverse body by printing on one side thereof, for each card to be produced, a pattern, symbol, character, numeral or the like necessary to the game or play and by applying to the other side thereof an adhesion surface;

forming of sheet material an obverse body having one side substantially blank and suitable for subsequent applying of a personalized design, for each card to be produced, by the user and the other side suitable for securement to said adhesion surface;

when the cards are to be used, printing said one side of said sheet material containing said obverse bodies with a common pattern, symbol, character, numeral or other personalized design which is a favorite of the user for each card to be produced, and applying said other side of said sheet material containing said obverse bodies to said other side of said sheet material containing said reverse bodies with said obverse bodies covering said adhesion surfaces and with the personalized design on the obverse bodies of each card to be produced superposed in alignment with the pattern or the like printed on said one side of the reverse body of each such card; and thereafter cutting the laminated structure comprised of the adhered together reverse body sheet material and obverse body sheet material into the required number of laminated cards.

* * * * *